US010431876B2

(12) United States Patent
Hwang et al.

(10) Patent No.: US 10,431,876 B2
(45) Date of Patent: Oct. 1, 2019

(54) BROADBAND ANTENNA MODULE FOR LTE

(71) Applicant: AMOTECH CO., LTD., Incheon (KR)

(72) Inventors: Chul Hwang, Incheon (KR); In-Jo Jeong, Incheon (KR); Sang-O Kim, Incheon (KR); Dong-Hwan Koh, Seoul (KR)

(73) Assignee: Amotech Co., Ltd., Incheon (KR)

( * ) Notice: Subject to any disclaimer, the term of this patent is extended or adjusted under 35 U.S.C. 154(b) by 0 days.

(21) Appl. No.: 15/746,195

(22) PCT Filed: Jul. 22, 2016

(86) PCT No.: PCT/KR2016/008045
§ 371 (c)(1),
(2) Date: Jan. 19, 2018

(87) PCT Pub. No.: WO2017/014598
PCT Pub. Date: Jan. 26, 2017

(65) Prior Publication Data

US 2018/0212311 A1 Jul. 26, 2018

(30) Foreign Application Priority Data

Jul. 22, 2015 (KR) ..... 10-2015-0103917

(51) Int. Cl.
*H01Q 1/24* (2006.01)
*H01Q 1/38* (2006.01)
(Continued)

(52) U.S. Cl.
CPC ..... *H01Q 1/243* (2013.01); *H01Q 1/38* (2013.01); *H01Q 5/335* (2015.01); *H01Q 9/045* (2013.01); *H01Q 9/0421* (2013.01); *H01Q 9/42* (2013.01)

(58) Field of Classification Search
CPC ..... H01Q 5/378; H01Q 9/0421
See application file for complete search history.

(56) References Cited

U.S. PATENT DOCUMENTS

2005/0280587 A1 12/2005 Svigelj et al.
2007/0229370 A1* 10/2007 Tan ..... H01Q 1/243 343/702
2011/0163937 A1* 7/2011 Jung ..... H01Q 1/243 343/893

FOREIGN PATENT DOCUMENTS

CN 1943076 A 4/2007
JP 2012-109809 A 6/2012
(Continued)

OTHER PUBLICATIONS

Office Action issued in Chinese Application No. 201680042572.3, dated May 30, 2019.

*Primary Examiner* — Daniel Munoz
(74) *Attorney, Agent, or Firm* — Baker & Hostetler LLP

(57) ABSTRACT

The disclosed broadband antenna module for LTE includes: a feeding pin and a direct short pin that are spaced apart from each other on one surface of a printed circuit board; a coupling short pin formed of a conductive material on the other surface of the printed circuit board and connected to a ground plane; and a radiation patch antenna including a dielectric and a radiation pattern formed on an outer circumference of the dielectric and mounted on one surface of the printed circuit board, in which the radiation pattern of the radiation patch antenna is directly connected to the feeding pin and direct short pin and coupled to the coupling short pin in an overlapping manner.

5 Claims, 8 Drawing Sheets

(51) Int. Cl.

| | |
|---|---|
| ***H01Q 9/42*** | (2006.01) |
| ***H01Q 5/335*** | (2015.01) |
| ***H01Q 9/04*** | (2006.01) |

(56) References Cited

FOREIGN PATENT DOCUMENTS

| | | | |
|---|---|---|---|
| JP | 2012-182632 | A | 9/2012 |
| KR | 10-2006-0109641 | A | 10/2006 |
| KR | 10-2009-0031753 | A | 3/2009 |
| KR | 10-2011-0030113 | A | 3/2011 |
| TW | 201427171 | A | 7/2014 |

* cited by examiner

| Band | FREQUENCY (MHz) | EFFICIENCY(%) | | | AVERAGE GAIN (dB) | | PEAK GAIN (dB) | |
|---|---|---|---|---|---|---|---|---|
| | | PRIOR ART | PRESENT INVENTION | DIFFERENCE | PRIOR ART | PRESENT INVENTION | PRIOR ART | PRESENT INVENTION |
| LTE17 | 704 | 49.04 | 51.83 | 2.00 | -3.09 | -2.85 | 0.74 | -0.64 |
| | 716 | 44.04 | 53.53 | 9.00 | -3.56 | -2.71 | 0.20 | -0.57 |
| | 734 | 49.22 | 63.72 | 14.00 | -3.08 | -1.96 | 0.37 | 0.09 |
| | 746 | 50.40 | 72.12 | 22.00 | -2.98 | -1.42 | 0.31 | 0.59 |
| LTE5 GMS850 WCDMA5 | 824 | 50.00 | 60.45 | 10.00 | -3.01 | -2.19 | 0.42 | 0.29 |
| | 849 | 46.40 | 55.84 | 9.00 | -3.33 | -2.53 | 0.23 | 0.23 |
| | 869 | 44.81 | 49.44 | 5.00 | -3.49 | -3.06 | 0.21 | -0.11 |
| | 894 | 40.21 | 46.58 | 6.00 | -3.96 | -3.32 | -0.37 | -0.12 |
| LTE2 WCDMA2 | 1850 | 53.45 | 68.12 | 15.00 | -2.72 | -1.67 | 2.42 | 2.25 |
| | 1910 | 49.71 | 71.43 | 22.00 | -3.04 | -1.46 | 2.18 | 2.80 |
| | 1930 | 37.72 | 64.33 | 27.00 | -4.23 | -1.92 | 0.64 | 2.48 |
| | 1990 | 43.09 | 70.05 | 27.00 | -3.66 | -1.55 | 1.05 | 2.38 |
| LTE4 WCDMA4 | 1710 | 70.26 | 51.67 | -19.00 | -1.53 | -2.87 | 3.41 | 1.67 |
| | 1755 | 57.18 | 54.97 | -3.00 | -2.43 | -2.60 | 2.54 | 1.96 |
| | 2110 | 44.24 | 78.70 | 33.00 | -3.54 | -1.04 | 0.52 | 2.16 |
| | 2155 | 39.54 | 76.15 | 37.00 | -4.03 | -1.18 | 0.48 | 2.62 |

FIG. 8

BROADBAND ANTENNA MODULE FOR LTE

CROSS-REFERENCE TO THE RELATED APPLICATIONS

This application is a National Stage of International Application No. PCT/KR2016/008045, filed Jul. 22, 2016, which claims priority from Korean Patent Application No. 10-2015-0103917, filed on Jul. 22, 2015 in the Korean Intellectual Property Office, the disclosure of which are incorporated herein by reference in their entirety.

TECHNICAL FIELD

Exemplary embodiments of the present invention relate to a broadband antenna module for long term evolution (LTE), and more particularly, to a broadband antenna module for LTE that is embedded in a portable terminal and performs LTE communication.

BACKGROUND ART

As propagation of portable terminals such as a smartphone, a tablet PC, or the like is increased, a data usage amount through a communication network is rapidly increasing.

In the conventional wireless mobile communication scheme which is commonly called 3G, a suddenly increased data usage amount may not be handled, thus problems such as call drop, wireless internet connection failure, and the like has occurred.

For this reason, a long term evolution (LTE) communication standard which improved a data transmission rate has been developed. The LTE communication standard is commonly called 4G, and has been popularized as a communication standard of portable terminals.

Recently, due to expansion of LTE frequency band in Korea and foreign countries, the LTE communication standard may use a frequency band of 704 to 894 MHz and 1710 and 2170 MHz.

A bandwidth of a low frequency band (baseband) of the LTE communication standard has been increased as compared to a frequency band of the 3G communication standard (e.g., 824 to 894 MHz, 1710 to 2170 MHz).

Accordingly, an antenna module for increasing a bandwidth of a low frequency band (baseband) of an LTE band has been demanded.

DISCLOSURE

Technical Problem

An object of the present invention is to provide a broadband antenna module for LTE in which a radiation pattern resonating in a low frequency band of an LTE band is formed by forming a coupling short pin to increase a few frequency bandwidth of the LTE band.

Technical Solution

According to an embodiment of the present invention, a broadband antenna module for LTE includes: a feeding pin formed on one surface of a printed circuit board; a direct short pin formed to be spaced apart from the feeding pin on one surface of the printed circuit board; a coupling short pin formed on the other surface of the printed circuit board and connected to a ground plane formed on the other surface of the printed circuit board; and a radiation patch antenna configured to include a dielectric and a radiation pattern formed on an outer circumference of the dielectric and mounted on one surface of the printed circuit board, in which the radiation patch antenna is mounted on one surface of the printed circuit board so that a portion of the radiation pattern is directly connected to the feeding pin, another portion of the radiation pattern is directly connected to the direct short pin, and still another portion of the radiation pattern is overlapped with the coupling short pin and connected with the coupling short pin in a coupling manner.

The radiation pattern may include a first radiation pattern directly connected to the feeding pin and the direct short pin to resonate in a first frequency band which is a high frequency band of an LTE frequency band.

The radiation pattern may further include a second radiation pattern directly connected to the feeding pin formed on one surface of the printed circuit board and coupled to the coupling short pin formed on the other surface of the printed circuit board to resonate in a second frequency band which is a low frequency band of the LTE frequency band, and the second frequency band may be a frequency band lower than the first frequency band.

The direct short pin may be formed of a conductive material, and connected to the ground plane formed on one surface of the printed circuit board.

The coupling short pin may overlap at least a portion of the direct short pin and a portion of the ground plane formed on one surface of the printed circuit board.

Advantageous Effects

According to the present invention, in the broadband antenna module for LTE, the radiation pattern resonating in a low frequency band is formed by forming the coupling short pin, such that it is possible to form the radiation pattern resonating in a low frequency band through a coupling effect between the radiation pattern and the coupling short pin.

Further, in the broadband antenna module for LTE, the coupling short pin overlaps a portion of the direct short pin and a portion of the ground plane connected to the direct short pin, such that it is possible to form the radiation pattern resonating in a low frequency band through the coupling effect between the radiation pattern and the coupling short pin.

Further, in the broadband antenna module for LTE, the radiation pattern for a low frequency band is formed by the coupling short pin, such that it is possible to increase a bandwidth and efficiency of the low frequency band in all LTE bands.

Further, in the broadband antenna module for LTE, the radiation pattern for a low frequency band is formed by the coupling short pin, such that it is possible to increase a bandwidth and efficiency of the low frequency band in all LTE bands.

DESCRIPTION OF DRAWINGS

FIGS. 4 to 8 are diagrams for describing broadband characteristics according to a configuration of the broadband antenna module for LTE according to the embodiment of the present invention.

MODE FOR INVENTION

Figure 1:
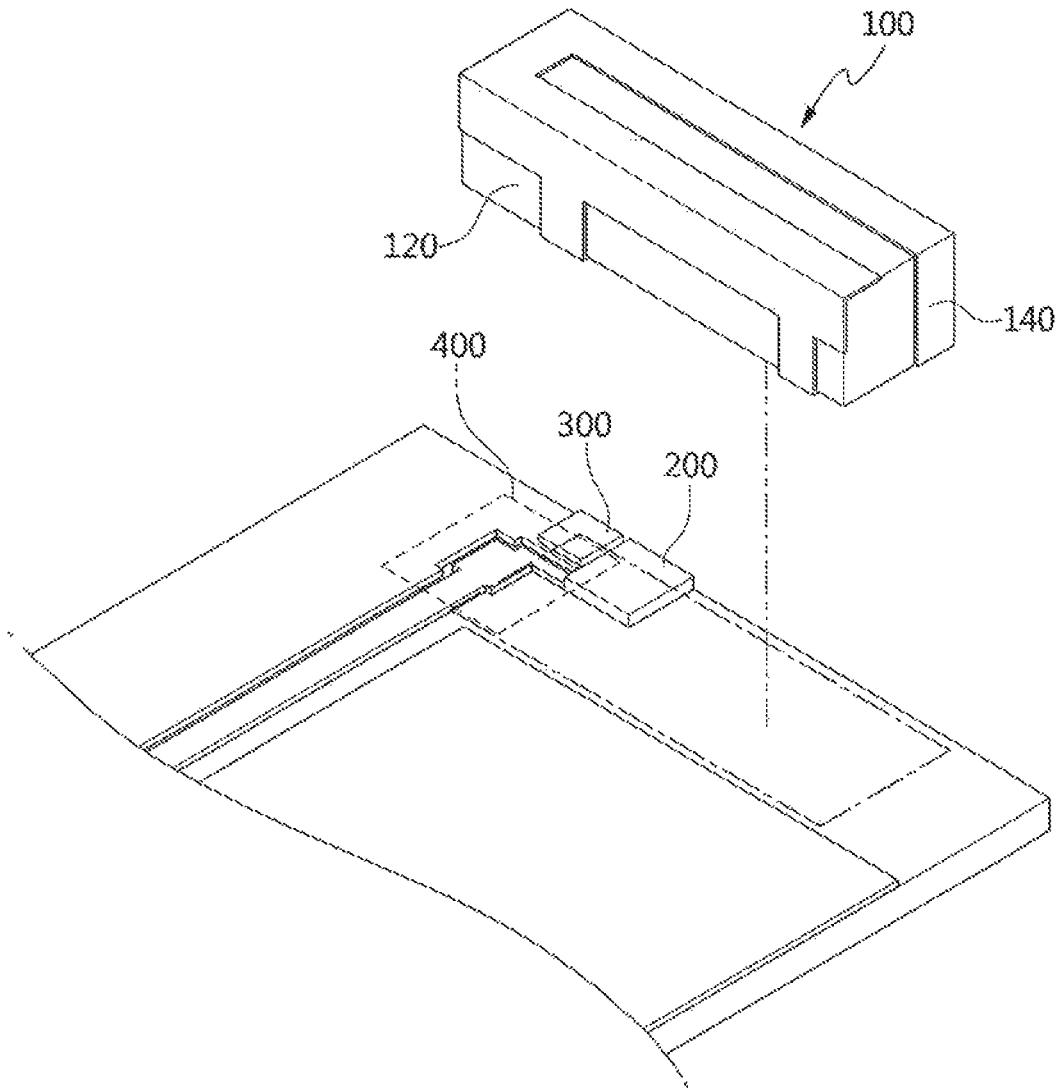
FIG. 1 is a diagram for describing a broadband antenna module for LTE according to an embodiment of the present invention.

Hereinafter, most preferred embodiments of the present invention will be described in detail with reference to the accompanying drawings so that those skilled in the art to which the present invention pertains may easily practice the technical idea of the present invention. First, it is to be noted that in adding reference numerals to elements of each drawing, like reference numerals refer to like elements even though like elements are shown in different drawings. Further, in describing embodiments of the present invention, when it is determined that detailed description of known functions or configuration may obscure the gist of the present invention, the detailed description will be omitted.

Referring to FIG. 1, a broadband antenna module for LTE according to an embodiment of the present invention is configured to include a radiation patch antenna 100, a feeding pin 200, a direct short pin 300, and a coupling short pin 400. Here, the feeding pin 200, the direct short pin 300, and the coupling short pin 400 may also be described as a feeding terminal, a direct short terminal, and a coupling short terminal.

The radiation patch antenna 100 is configured to include a dielectric 120 and a radiation pattern 140 formed on the dielectric 120. Here, the dielectric 120 is formed by sintering a dielectric material such as ceramic. The radiation pattern 140 is formed by printing or plating a conductive material on a surface of the dielectric 120. Here, the radiation pattern 140 may be configured of a conductive material such as nickel, gold, copper, silver, and the like.

The radiation patch antenna 100 is mounted on one surface of a printed circuit board 500 embedded in a portable terminal. Accordingly, the radiation pattern 140 is connected to the feeding pin 200, the direct short pin 300, and the coupling short pin 400 formed on the printed circuit board 500.

At this time, the radiation pattern 140 is directly connected to the feeding pin 200 and the direct short pin 300 that are formed on one surface (e.g., upper surface) of the printed circuit board 500 at a predetermined position. The radiation pattern 140 is connected with the coupling short pin 400 formed on the other surface (e.g., lower surface) of the printed circuit board 500 while being spaced apart from the coupling short pin 400 by a predetermined interval (that is, an interval corresponding to a thickness of the printed circuit board 500) at a predetermined position in a coupling manner.

As the radiation patch antenna 100, a broadband antenna in a form of planar inverted F antenna (PIFA) including a first radiation pattern resonating in a high frequency band (i.e., 1710 to 2170 MHz) and a second radiation pattern resonating in a low frequency band (i.e., 704 to 894 MHz) through connection with the feeding pin 200, the direct short pin 300, and the coupling short pin 400 is configured.

The feeding pin 220 is formed by printing or plating a conductive material on one surface (i.e., upper surface) of the printed circuit board 500 embedded in the portable terminal. At this time, the feeding pin 200 may be formed of a conductive material such as nickel, gold, copper, silver, and the like.

As the radiation patch antenna 100 is mounted on the printed circuit board 500, the feeding pin 200 is directly connected by being in contact with the radiation pattern 120. At this time, the feeding pin 200 is connected to a signal processing module (not illustrated) mounted on the printed circuit board 500.

Figure 2:
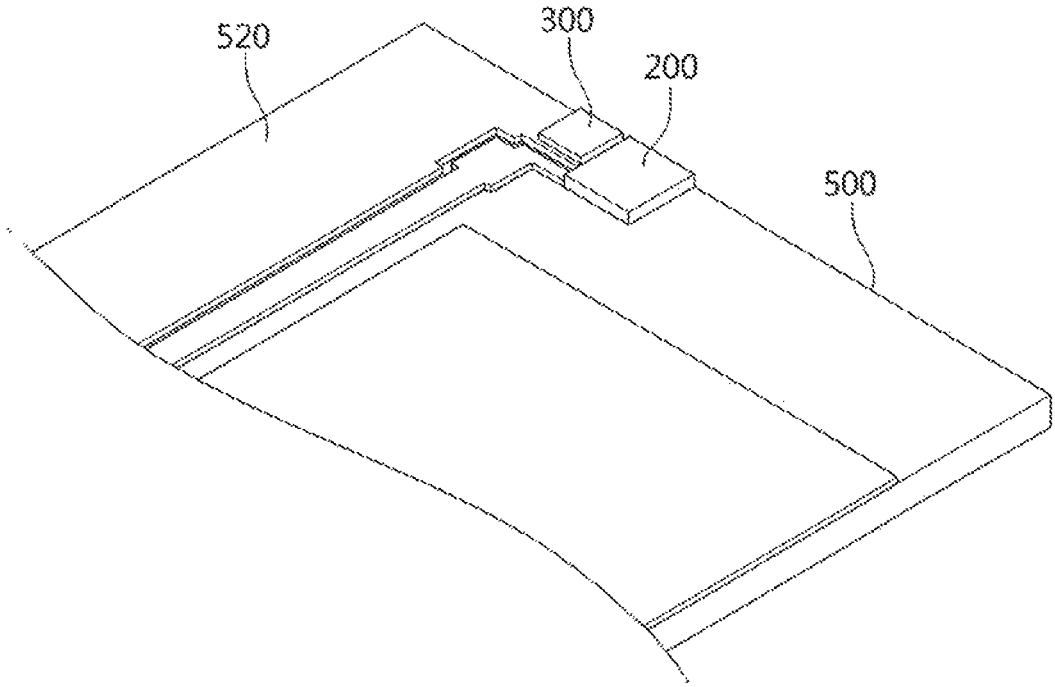
FIG. 2 is a diagram for describing a feeding pin of FIG. 1.

The feeding pin 200 feeds power supplied from the signal processing module to the radiation pattern 140. To this end, the feeding pin 200 is formed in a predetermine shape (e.g., rectangular shape) on one surface (i.e., surface on which the radiation patch antenna 100 is mounted) of the printed circuit board 500 as illustrated in FIG. 2. As the radiation patch antenna 100 is mounted on one surface of the printed circuit board 500, the feeding pin 200 is directly connected to the radiation pattern 140 at a predetermined position to feed power to the radiation pattern 140.

The direct short pin 300 is formed on the printed circuit board 500 embedded in a portable terminal. The direct short pin 300 is formed by printing or plating a conductive material on one surface of the printed circuit board 500. At this time, the direct short pin 300 is connected to a ground plane 520 formed on one surface of the printed circuit board 500. The direct short pin 300 is formed to be spaced apart from the feeding pin 200 formed on one surface of the printed circuit board 500 by a predetermined interval.

As the radiation patch antenna 100 is mounted on the printed circuit board 500, the direct short pin 300 is directly connected to the radiation pattern 140 at a predetermined position.

The coupling short pin 400 is formed on the other surface of the printed circuit board 500 embedded in a portable terminal. The coupling short pin 400 is formed by printing or plating a conductive material on the other surface of the printed circuit board 500.

Figure 3:
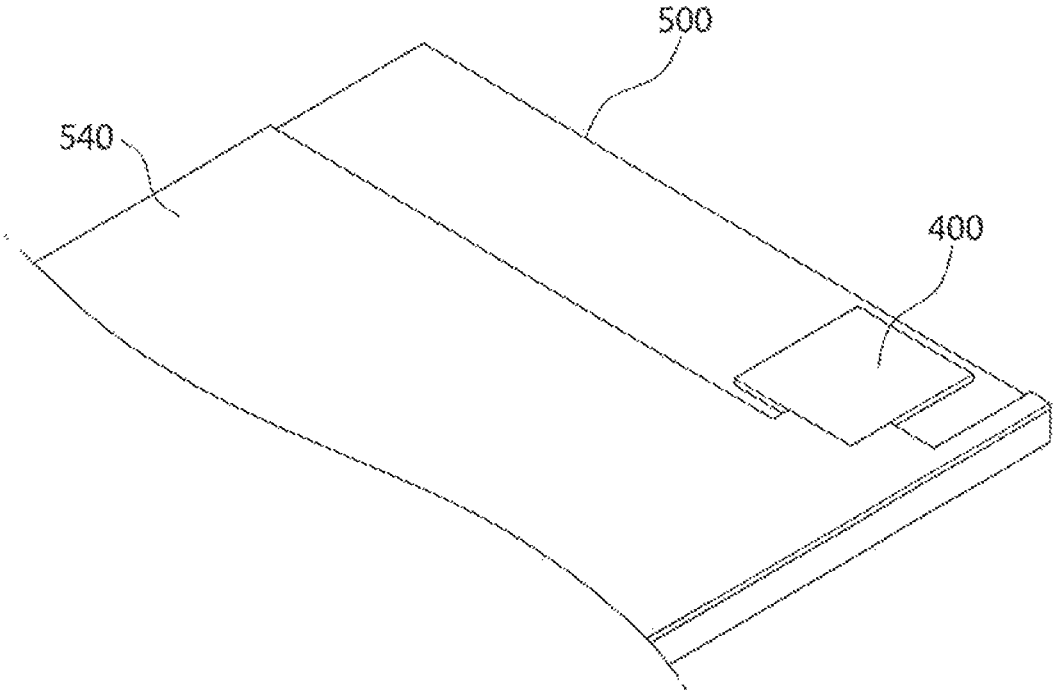
FIG. 3 is a diagram for describing a coupling short pin of FIG. 1.

At this time, as illustrated in FIG. 3, the coupling short pin 400 is connected to a ground plane 540 formed on the other surface of the printed circuit board 500. The coupling short pin 400 is disposed to overlap at least a portion of the direct short pin 300 formed on one surface of the printed circuit board 500 and a portion of the ground plane 520. At this time, as the coupling short pin 408 is formed on the other surface of the printed circuit board 500, the coupling short pin 400 is spaced apart from the direct short pin 300 formed on one surface of the printed circuit board 500 and the ground plane 520 by a predetermined interval. Here, the coupling short pin 400 is spaced apart from the direct short pin 300 by a thickness of the printed circuit board 500 (e.g., about 1.6 mm) or more.

As the coupling short pin 400 is formed on the other surface of the printed circuit board 500, the coupling short pin 400 is spaced apart from the radiation patch antenna 100 mounted on one surface of the printed circuit board 500 by a predetermined interval. AT this time, the coupling short pin 400 is spaced apart from the radiation patch antenna 100 by the thickness of the printed circuit board 500 or more.

The coupling short pin 400 is formed to overlap a predetermined area of the radiation pattern 140 disposed on one surface of the printed circuit board 500. Accordingly, the coupling short pin 400 is connected with the radiation pattern 140 at the overlapped area in a coupling manner.

Figure 4:
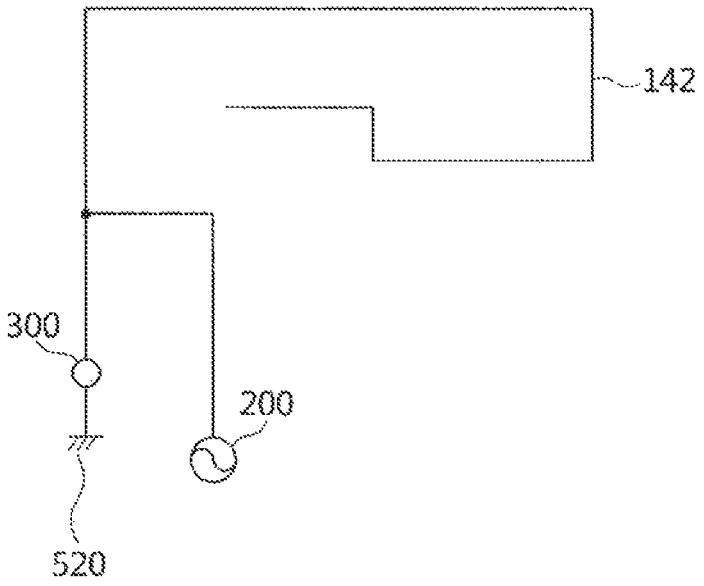

By the above-described configuration, the radiation patch antenna 100 has a first radiation pattern 142 formed to resonate in a high frequency band of about 1710 to 2170 MHz. That is, the radiation patch antenna 100 is directly connected (in contact with) the direct short pin 300 at a predetermined area. The radiation patch antenna 100 has the first radiation pattern 142 formed to resonate in the high frequency band through impedance matching with the connected direct short pin 300, which may be indicated by an equivalent circuit as in FIG. 4.

Figure 5:
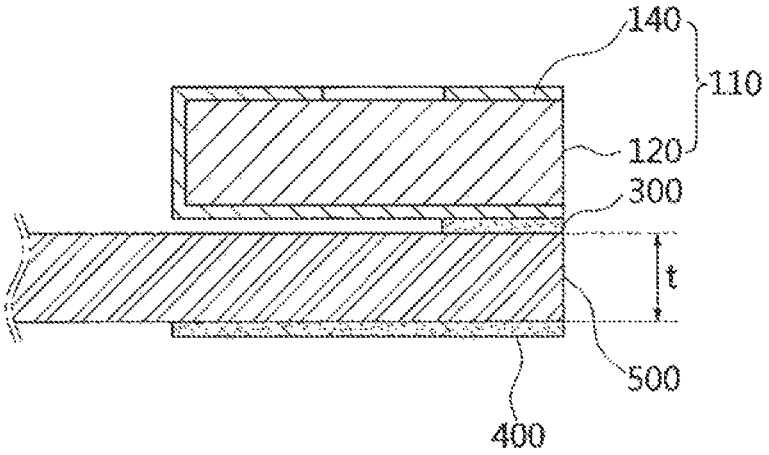

In addition, the radiation patch antenna 100 has a second radiation pattern 144 formed to resonate in a low frequency band of about 704 to 894 MHz. That is, as illustrated in FIG. 5, the radiation patch antenna 100 is electrically connected in a coupling manner with the coupling short pin 400 spaced apart from the radiation patch antenna 100 by the printed circuit board 500 by a predetermined interval (i.e., by a thickness t of the printed circuit board 500 or more). The radiation patch antenna 100 has the second radiation pattern 144 formed to resonate in the low frequency band by coupling a part of a current looped through the first radiation pattern 142 through the coupling short pin 400.

Figure 6:
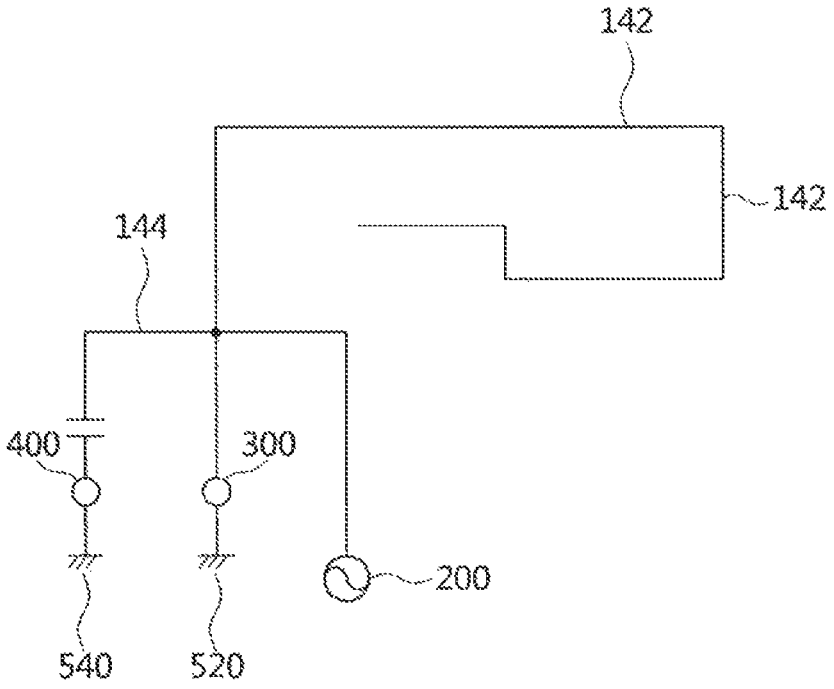

Accordingly, as illustrated in FIG. 6, the broadband antenna module for LTE is operated as a broadband antenna receiving LTE signals of both of the low frequency band and the high frequency band. At this time, as the broadband antenna module for LTE, a broadband antenna in the form of PIFA represented as an equivalent circuit resonating in the low frequency band and the high frequency band is configured.

Figure 7:
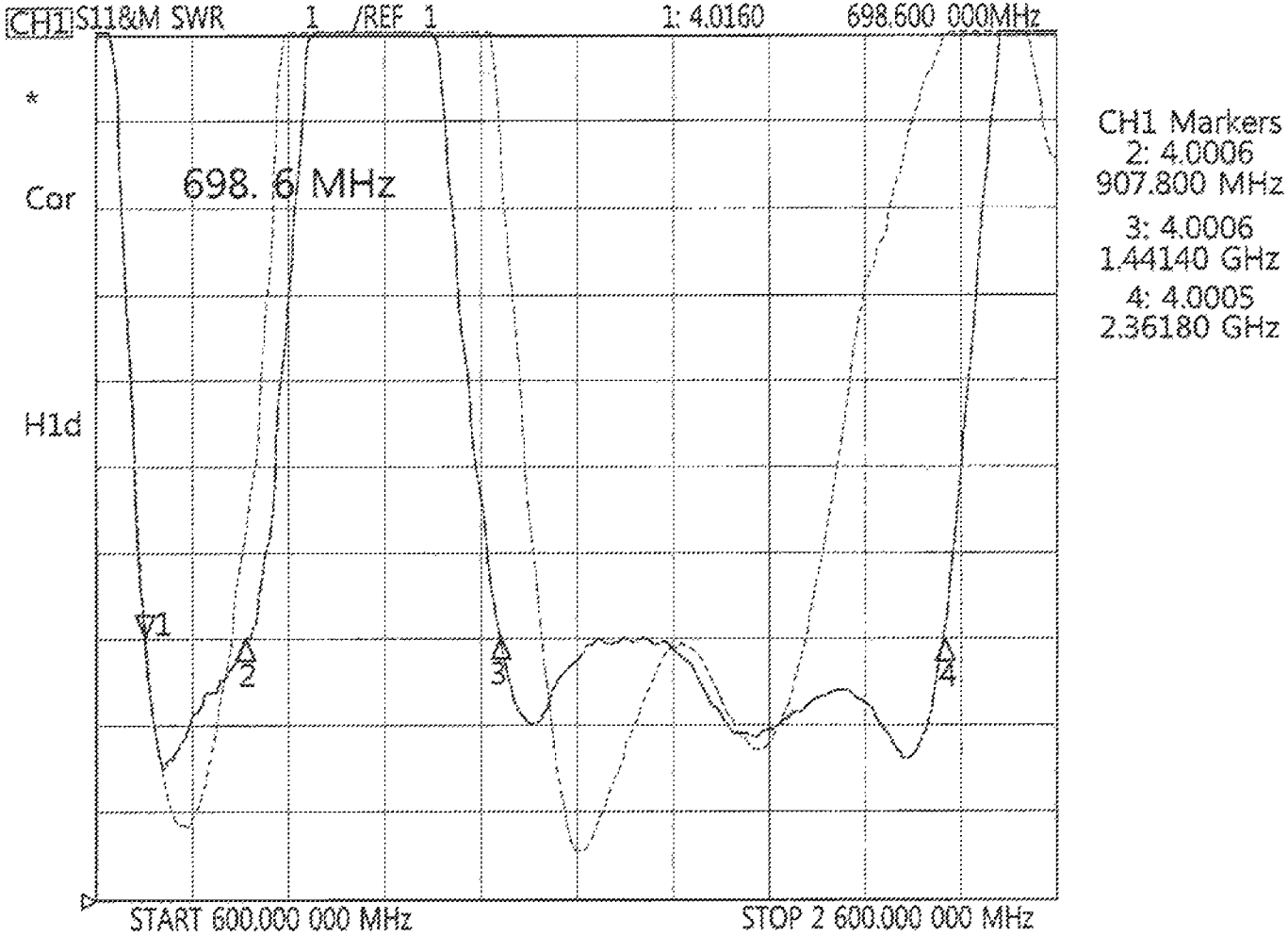

Referring to FIG. 7, in the conventional antenna module for LTE, a bandwidth of about 213 MHz is formed in the low frequency band, and a bandwidth of about 580 MHz is formed in the high frequency band.

On the contrary, in the broadband antenna module for LTE according to the embodiment of the present invention, a bandwidth of about 273 MHz is formed in the low frequency band, and a bandwidth of about 711 MHz is formed in the high frequency band.

Through this, it may be appreciated that in the broadband antenna module for LTE, a bandwidth is expanded by about 60 MHz in the low frequency band, and a bandwidth is expanded by about 131 MHz in the high frequency band. This means that a bandwidth is expanded by about 30% in the low frequency band, and a bandwidth is expanded by about 22% in the high frequency band, in comparison to the conventional antenna module for LTE.

As such, in the broadband antenna module, the coupling short pin 400 is formed on the other surface (i.e., back surface) of the printed circuit board 500, such that a bandwidth is increased by about 30% in the low frequency band, and a bandwidth is increased by about 22% in the high frequency band in the frequency bands for LTE.

Efficiency and gains of the conventional antenna module for LTE and the broadband antenna module for LTE according to the embodiment of the present invention for each band used for LTE will be compared and described with reference to FIG. 8.

First, in LTE17 BAND using an uplink frequency of 704 to 716 MHz and a downlink frequency of 734 to 746 MHz, efficiency of the conventional antenna module for LTE is about 44.04 to 50.40%, and efficiency of the broadband antenna module for LTE according to the present embodiment is about 51.83 to 72.12%.

Through this, it may be appreciated that the efficiency of the broadband antenna module for LTE is increased by about 2 to 9% in the uplink frequency band of the LTE17 BAND, and increased by about 14 to 22% in the downlink frequency band.

Next, in LTE5 (GMS850, WCDMA5) BAND using an uplink frequency of 824 to 849 MHz and a downlink frequency of 869 to 894 MHz, efficiency of the conventional of antenna module for LTE is about 40.21 to 50.00%, and efficiency of the broadband antenna module for LTE according to the present embodiment is about 46.58 to 60.45%.

Through this, it may be appreciated that the efficiency of the broadband antenna module for LTE is increased by about 9 to 10% in the uplink frequency band of the LTE5 BAND, and increased by about 5 to 6% in the downlink frequency band.

Next, in LTE2 (WCDMA2) BAND using an uplink frequency of 1850 to 1910 MHz and a downlink frequency of 1930 to 1990 MHz, efficiency of the conventional antenna module for LTE is about 40.21 to 50.00%, and efficiency of the broadband antenna module for LTE according to the present embodiment is about 46.58 to 60.45%.

Through this, it may be appreciated that the efficiency of the broadband antenna module for LTE is increased by about 15 to 22% in the uplink frequency band of the LTE2 BAND, and increased by about 27% in the downlink frequency band.

Next, in LTE4 (WCDMA4) BAND using an uplink frequency of 1710 to 1755 MHz and a downlink frequency of 2110 to 2155 MHz, efficiency of the conventional antenna module for LTE Is about 39.54 to 70.26%, and efficiency of the broadband antenna module for LTE according to the present embodiment is about 51.67 to 78.70%.

Through this, it may be appreciated that the efficiency of the broadband antenna module for LTE is decreased by about 3 to 19% in the uplink frequency band of the LTE5 BAND, but increased by about 33 to 37% in the downlink frequency band.

As described above, in the broadband antenna module for LTE, the radiation pattern resonating in a low frequency band is formed by forming the coupling short pin, such that it is possible to form the radiation pattern resonating in a low frequency band through a coupling effect between the radiation pattern and the coupling short pin.

Further, in the broadband antenna module for LTE, the coupling short pin overlaps a portion of the direct short pin and a portion of the ground plate connected to the direct short pin, such that it is possible to form the radiation pattern resonating in a low frequency band through the coupling effect between the radiation pattern and the coupling short pin.

Further, in the broadband antenna module for LTE, the radiation pattern for a low frequency band is formed by the coupling short pin, such that it is possible to increase a bandwidth and efficiency of the low frequency band in all LTE bands.

Further, in the broadband antenna module for LTE, the radiation pattern for a low frequency band is formed by the coupling short pin, such that it is possible to increase a bandwidth and efficiency of the low frequency band in all LTE bands.

Hereinabove, the preferred embodiments according to the present invention have been described, but various modifications may be made, and it is understood that a person having ordinary skill in the art may practice various modifications and changes without departing from the scope of claims of the present invention.

The invention claimed is:

1. A broadband antenna module for LTE, comprising:

a feeding pin formed on one surface of a printed circuit board;

a direct short pin formed to be spaced apart from the feeding pin on one surface of the printed circuit board;

a coupling short pin formed on the other surface of the printed circuit board and connected to a ground plane formed on the other surface of the printed circuit board; and a radiation patch antenna configured to include a dielectric and a radiation pattern formed on an outer circumference of the dielectric and mounted on one surface of the printed circuit board, wherein the radiation patch antenna is mounted on one surface of the printed circuit board so that a portion of the radiation pattern is directly connected to the feeding pin, another portion of the radiation pattern is directly connected to the direct short pin, and still another portion of the radiation pattern is overlapped with the coupling short pin and connected with the coupling short pin in a coupling manner, wherein the radiation pattern of the radiation patch antenna is directly connected to the feeding pin and the direct short pin to resonate in a first frequency band, and is coupled to the coupling short pin formed on the other surface of the printed circuit board to resonate in a second frequency band.

2. The broadband antenna module of claim 1, wherein the radiation pattern includes a first radiation pattern directly connected to the feeding pin and the direct short pin to resonate in the first frequency band which is a high frequency band of an LTE frequency band.

3. The broadband antenna module of claim 2, wherein the radiation pattern further includes a second radiation pattern directly connected to the feeding pin formed on one surface of the printed circuit board and coupled to the coupling short pin formed on the other surface of the printed circuit board to resonate in the second frequency band which is a low frequency band of the LTE frequency band, and the second frequency band is a frequency band lower than the first frequency band.

4. The broadband antenna module of claim 1, wherein the direct short pin is formed of a conductive material, and connected to the ground plane formed on one surface of the printed circuit board.

5. The broadband antenna module of claim 4, wherein the coupling short pin overlaps at least a portion of the direct short pin and a portion of the ground plane formed on one surface of the printed circuit board.

* * * * *